US005187523A

United States Patent [19]

Osawa

[11] Patent Number: 5,187,523

[45] Date of Patent: Feb. 16, 1993

[54] DEVELOPING APPARATUS FOR DEVELOPING ELECTROSTATIC LATENT IMAGE USING TWO COMPONENT DEVELOPER

[75] Inventor: Keishi Osawa, Yokohama, Japan

[73] Assignee: Canon Kabushiki Kaisha, Tokyo, Japan

[21] Appl. No.: 757,637

[22] Filed: Sep. 11, 1991

[30] Foreign Application Priority Data

Sep. 12, 1990 [JP] Japan ..... 2-243451

[51] Int. Cl.[5] ..... G03G 15/09

[52] U.S. Cl. ..... 355/251; 355/253; 355/259; 355/246; 118/658

[58] Field of Search ..... 355/245, 251, 253, 259, 355/246; 118/644, 656–658, 661

[56] References Cited

U.S. PATENT DOCUMENTS

| | | | |
|---|---|---|---|
| 4,292,387 | 9/1981 | Kanbe et al. | 118/657 X |
| 4,425,373 | 1/1984 | Hosono et al. | 118/657 X |
| 4,444,864 | 4/1984 | Takahashi | 118/657 X |
| 4,473,627 | 9/1984 | Kanbe et al. | 118/657 X |
| 4,607,933 | 8/1986 | Haneda et al. | 118/657 X |
| 4,610,531 | 9/1986 | Hayashi et al. | 118/657 X |
| 4,797,335 | 1/1989 | Hiratsuka et al. | 118/657 X |
| 4,933,254 | 6/1990 | Hosoi et al. | 355/251 X |
| 5,030,996 | 7/1991 | Tajima et al. | 355/246 |
| 5,066,979 | 11/1991 | Goto et al. | 355/245 X |

*Primary Examiner*—A. T. Grimley
*Assistant Examiner*—Matthew S. Smith
*Attorney, Agent, or Firm*—Fitzpatrick, Cella, Harper & Scinto

[57] ABSTRACT

A developing apparatus includes a movable developer carrying member for carrying a layer of a developer containing toner particles and magnetic carrier particles to a developing zone, the toner particles and magnetic carrier particles being charged to opposite polarities; a stationary magnet disposed on a side of the developer carrying member opposite the image bearing member, the magnet forming a magnetic brush wherein the developer is contactable to the image bearing member in the developing zone; a voltage source for producing an oscillating electric field in the developing zone by application of an oscillating bias voltage to the developer carrying member; wherein the oscillating bias voltage satisfies a maximum Vu1max of a potential difference Vu1 between an image portion potential of the electrostatic image and a potential of the developer carrying member in the transfer phase of the oscillating electric field, is larger than a maximum Vr1max of a potential difference Vr1 therebetween in the back transfer phase; a time integration Iu1 of the potential difference Vu1 is larger than a time integration Ir1 of the potential difference Vr1; a maximum Vu2max of a potential differnece Vu2 between a non-image portion potential of the electrostatic latent image and a potential of the developer carryign member in the transfer phase of the oscillating electric field, is not less than a maxiumu Vr2max of a potential difference Vr2 therebetween in the back transfer phase; and a time integration Iu2 of the potential difference Vu1 is not more than a time integration Ir2 of the potential difference Vr2.

12 Claims, 5 Drawing Sheets

DEVELOPING APPARATUS FOR DEVELOPING ELECTROSTATIC LATENT IMAGE USING TWO COMPONENT DEVELOPER

FIELD OF THE INVENTION AND RELATED ART

The present invention relates to a developing apparatus for developing an electrostatic latent image using a two component developer containing toner and magnetic carrier particles wherein a vibrating or oscillating bias voltage is applied to a developer carrying member for carrying the developer to a developing zone.

A developing apparatus is known wherein a so-called two component developer containing toner and magnetic carrier particles are used to develop an electrostatic latent image, and wherein an oscillating electric field is formed between the developer carrying member and an image bearing member having the electrostatic latent image, as disclosed in U.S. Pat. No. 4,933,254. In this apparatus, the electric field for urging the toner from the developer carrying member to the image bearing member is made stronger during the toner transfer phase, and therefore, more toner particles are supplied to the latent image by the strong electric field. During a back transfer phase in which the electric field is effective to urge the toner back to the developer carrying member, fog producing toner particles are removed from the image bearing member in a white background area whether the coulomb force between the toner charge and the latent image is weak. As a result, good developed images can be provided with high image density and without foggy background.

However, such a developing method involves a problem that during the back transfer phase, in addition to the back-transfer of the toner from the image bearing member, carrier particles which are charged to the polarity opposite from that of the toner are released from a developer magnetic brush and are deposited onto the image bearing member. If this occurs, the image is contaminated, or the image bearing member is damaged, and in addition, improper image transfer occurs. This frequently occurs if a DC voltage component of the oscillating bias voltage is increased, or if the particle size of the carrier particles is reduced.

If a peak-to-peak value of the oscillating bias voltage is reduced in an attempt to reduce the back transfer electric field for the purpose of preventing the carrier particles from being carried over to the outside of the developing zone by the image bearing member, the transfer electric field is also reduced with the result of reduced image density so that the reproducibility of line images and halftone images is degraded.

SUMMARY OF THE INVENTION

Accordingly, it is a principal object of the present invention to provide a developing apparatus wherein the carrier particles are prevented from being carried over to the outside of the developing zone by the image bearing member It is another object of the present invention to provide a developing apparatus capable of producing images of high image density.

It is a further object of the present invention to provide a developing apparatus having good reproducibility for line images.

It is a further object of the present invention to provide a developing apparatus having a high reproducibility for halftone images.

In an embodiment of the present invention, the magnetic brush of the developer containing the toner particles and magnetic carrier particles is brought into contact with the image bearing member in the developing zone by a developing magnetic field.

An oscillating bias voltage is applied to the developer carrying member. The oscillating bias voltage satisfies a maximum Vu1max of a potential difference Vu1 between an image portion potential of the electrostatic latent image and a potential of the developer carrying member in the transfer phase of the oscillating electric field, is larger than a maximum Vr1max of a potential difference Vr1 therebetween in the back transfer phase; a time integration Iu1 of the potential difference Vu1 is larger than a time integration Ir1 of the potential difference Vr1; a maximum Vu2max of a potential difference Vu2 between a non-image portion potential of the electrostatic latent image and a potential of the developer carrying member in the transfer phase of the oscillating electric field, is not less than a maximum Vr2max of a potential difference Vr2 therebetween in the back transfer phase; and a time integration Iu2 of the potential difference Vu1 is not more than a time integration Ir2 of the potential difference Vr2.

In this Specification, the image portion of the electrostatic latent image is a portion having the maximum potential in the absolute value when the developing action is a regular development using toner particles charged to the polarity opposite from the latent image potential; and the non-image portion of the electrostatic latent image is a portion having the minimum potential in the absolute value. Therefore, when the image bearing member is in the form of an electrophotographic photosensitive member, the image portion is the portion which is not exposed to light, that is, the dark portion; and the non-image portion is the portion which is exposed to most intense light, that is, the light potential portion. In the case of a reverse development using toner particles charged to the same polarity as that of the latent image, the non-image portion of the electrostatic latent image is the portion having the maximum potential in the absolute value; and the image portion of the electrostatic latent image is the portion having the minimum potential in the absolute value Therefore, when the image bearing member is in the form of an electrophotographic photosensitive member, the non-image portion is the portion not exposed to the light, that is, the dark potential portion; and the image portion is the portion exposed to the most intense light, that is, the so-called light potential portion.

In either case, the region having the potential between that of the image portion and that of the non-image portion is a half tone portion.

In this specification, the transfer phase is the phase in which the potential (bias voltage) of the image bearing member relative to the potential of the latent image is effective to provide the toner particles with a force toward the image bearing member away from the developer carrying member; and the back transfer phase is the phase in which the potential (bias voltage) of the developer carrying member relative to the potential of the latent image is effective to provide the toner particles with a force toward the developer carrying member away from the image bearing member.

In this specification, time integration of the potential difference is the integration, with time, of the absolute value of the potential difference in one period of the oscillating bias voltage.

In this specification, "high or low potential" or "large or small potential difference" is based on the absolute values of the potential or the potential difference.

In this specification, duty ratio is defined as $t_1/(t_1+t_2)$, in which $t_1$ and $t_2$ are defined as follows:

1. $t_1+t_2$ is one period of the oscillating voltage:
2. Between 0 and $t_1$, $(V(t)-Vs)$ has the same polarity as $(V_1-Vs)$:
3. Between $t_1$ and $t_1+t_2$, $(V(t)-Vs)$ has the same polarity as $(V_2-Vs)$:

$$4.\ \int_0^{t1} |V(t) - Vs|dt = \int_{t1}^{t1+t2} |V(t) - Vs|dt:$$

where V(t) is the oscillating bias voltage which is a function of time t, $V_1$ is the peak voltage of the bias voltage at the non-image portion side of the latent image, $V_2$ is the peak voltage at the image portion side, Vs is a value between $V_1$ and $V_2$.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

For the purpose of simplicity of explanation, the following description will deal with the case of a positive latent image developed with negatively charged toner particles (regular development).

Figure 2:
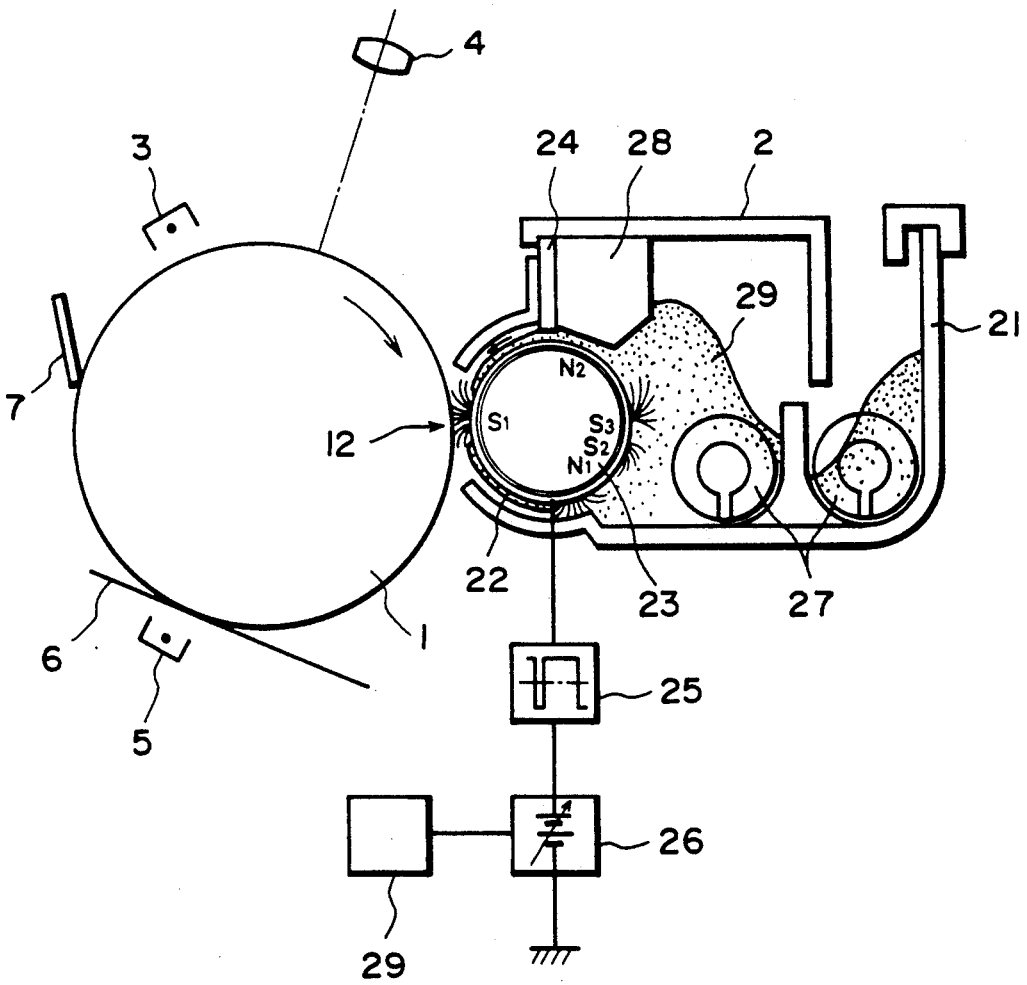
FIG. 2 is a sectional view of an image forming apparatus according to an embodiment of the present invention.

Referring first to FIG. 2, there is shown an image forming apparatus according to an embodiment of the present invention which comprises a cylindrical electrophotographic photosensitive drum rotatable in the direction indicated by an arrow. In this embodiment, it comprises an electrically grounded metal drum and a photosensitive layer in the form of an amorphous silicon layer, for example.

Around the photosensitive drum 1, there are disposed a charger 3, an image exposure device 4, a developing device 2, an image transfer device 5 and a cleaning device 7. The toner remaining on the surface of the drum 1 after the image transfer, is removed by a cleaning device 7, the surface of the drum 1 which has been thus cleaned and therefore substantially free from the residual toner with charged by the charger 3 substantially uniformly to the positive polarity. Then, the drum 1 is exposed to image light by the exposure device 4 so that an electrostatic latent image is formed. The electrostatic latent image has an image portion potential (dark potential $V_D$) of +400 V, for example, and a non-image portion potential (light potential $V_L$) of +50 V, for example. The electrostatic latent image is developed in the developing zone 12 by the developing device which will be described in detail hereinafter. The toner image thus provided is transferred onto the transfer material 6 in the form of a sheet of paper or the like by the transfer device 5.

The developing device 2 comprises a developer container 21, a developer carrying sleeve 22, a magnet 23, a screw 27 and a non-magnetic blade 24. The container 21 contains a so-called two component developer 29 in the form of a mixture of high resistance magnetic carrier particles (ferrite particles coated with very thin resin layer, for example) and insulative non-magnetic toner particles. The sleeve 22 is in the form of a cylindrical member of non-magnetic material such as stainless steel or aluminum. It is supported by the container 21 and is rotated in the direction indicated by an arrow at the peripheral speed which is the same as or higher than the peripheral speed of the drum 1. The magnet 23 is stationarily disposed in the sleeve 22. The screw 27 functions to stir the developer in the container 21. The non-magnetic blade 24 functions to regulate a thickness of the developer layer to be carried to the developing zone (the zone where the toner is supplied to the latent image) by the sleeve 22. The minimum clearance between the sleeve 22 and the drum 1 in the developing zone is 0.5 mm in this example.

The fixed magnet 23 has a magnetic pole S1 for forming a magnetic brush of the developer in the developing zone 12. In the developing zone 12, the brush rubs the drum 1. Magnetic poles S2 and S3 have the same magnetic polarity to produce a repelling magnetic field therebetween so as to remove the developer after the developing action once from the sleeve. The magnetic pole S3 is effective to deposit the developer stirred by the screw 27 onto the sleeve 22. Magnetic poles N1 and N2 are contribute to conveying the developer.

The toner particles are triboelectrically charged mainly by the friction with the carrier particles to a negative polarity to such an extent as to develop the latent image. The carrier particles are charged to a positive polarity by the friction with the toner particles. Electric power sources 25 and 26 generate the vibrating or oscillating bias voltage. The voltage source 25 generates an alternating voltage having a duty ratio not more than 0.5, and the voltage source 26 generates a DC voltage Vdc having a voltage level which is between the light potential $V_L$ and the dark potential $V_D$ of the latent image. Thus, the sleeve 22 is supplied with an oscillating bias voltage in the form of an AC voltage biased with a DC voltage. Such a bias voltage is effective to generate an oscillating electric field in the developing zone. The image portion potential $V_D$ and the non-image portion potential $V_L$ of the latent image is between a first peak level V1 and a second peak level V2 of the oscillating bias voltage. The voltage source 26 may be omitted.

By application of the bias voltage to the sleeve 22, the transfer electric field and the backtransfer electric field alternately appear in the developing zone 12. That is, the electric field having alternating directions is formed between the sleeve 22 and the drum 1, by which the toner and carrier particles are reciprocated so that a sufficient amount of the toner is supplied to the drum. The amount of toner deposited onto the drum and the amount of toner removed from the drum are different in the image portion than in the non-image portion. As the gap between the drum 1 and the sleeve 22 is increased, the strength of the electric field therebetween is weakened, and the developing action is completed. In this manner, the amount of toner remaining on the drum 1 depends on the potential of the electrostatic latent image, and therefore, a toner image is formed. The developer having been subjected to the developing action is fed back to the developer sump in container 21, so that the developer on the sleeve is replaced.

The developer removed from the sleeve is moved in the longitudinal direction of the sleeve by two screws 27, and is therefore, stirred thereby. The toner is supplied thereto at proper timing under the control of a toner content control means. By rotation of the screws and up and down motion by the developer guide 28, the carrier and toner particles are sufficiently stirred and mixed. Thus, developer having the proper electric charge and the proper toner content is passed under the doctor blade and is supplied for the developing action.

Figure 3:
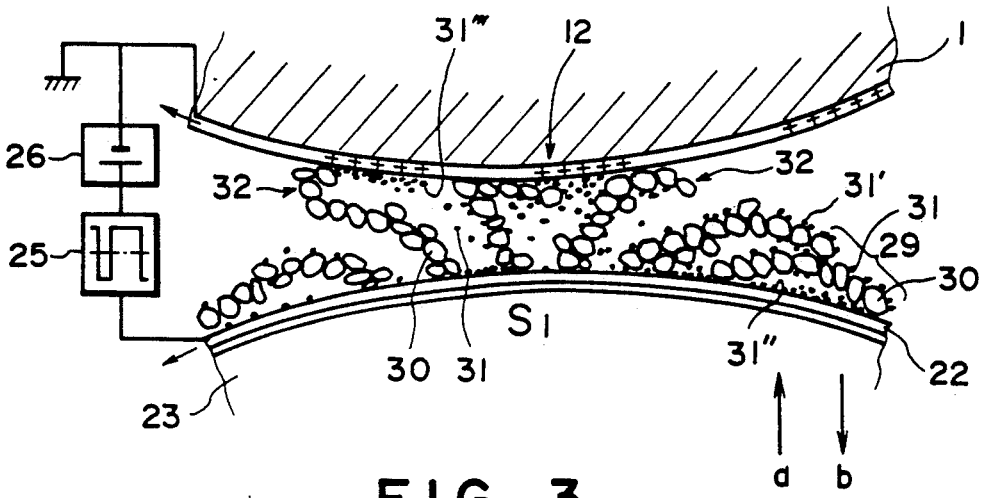
FIG. 3 is an enlarged sectional view of a developing zone.

FIG. 3 is an enlarged sectional view of the developing zone 12 illustrating the preferable developing action. The photosensitive drum 1 retains the electric charge constituting the latent image. In this embodiment, the electric charge constituting the latent image is positive, and therefore, the toner particles 31 are charged to the negative polarity, and the carrier particles 30 are charged to the positive polarity. In this embodiment, the photosensitive drum 1 and the sleeve 22 rotate in the directions indicated by the arrows so as to provide movement in the same peripheral direction in the developing zone 12. In the space therebetween, an oscillating electric field is formed. The magnetic pole S1 of the magnet 23 within the sleeve 22 is so positioned as to correspond to the position where the clearance between the photosensitive drum 1 and the sleeve 22 is minimum. In the gap, the developer 29 in the form of a mixture of the magnetic carrier particles 30 and the toner particles 31 is conveyed into the space by the rotation of the sleeve 22.

A volumetric ratio of the magnetic carrier particles in the developing zone 12 is 1.5–30%, and therefore, the amount of the magnetic carrier particles 30 is relatively small in the developing zone. The small amount of magnetic particles 30 form sparse chains 32 of magnetic particles on the sleeve 22 by the magnetic pole S1.

Due to the larger mobility of the magnetic particles 30 provided by the sparseness, the action of the magnetic particles 30 is peculiar.

More particularly, the sparse chains 32 of the magnetic particles are effective to open to the drum 1 both of the surface of the sleeve 22 and the surfaces of the magnetic particles. Because of this, the toner particles 31' deposited on the surfaces of the magnetic particles can be supplied to the photosensitive drum without obstruction, and in addition, the uniformly distributed open surface of the sleeve permits the toner particles 31'' deposited on the surface of the sleeve to transfer therefrom to the surface of the photosensitive drum by the oscillating electric field. In this manner, the development efficiency is increased, and therefore, the image density, the reproducibility of halftone images and the reproducibility of thin line images are improved.

In the transfer phase, the electric field is directed as indicated by an arrow b. Since the toner particles on the surfaces of the sleeve 21 and the magnetic particles 30 have been charged to the negative polarity, as described hereinbefore, the toner particles are transferred onto the drum 1 by the electric field in the direction b. Since the chains 32 are sparsely erected on the sleeve 22, and therefore, the surface of the sleeve 22 is exposed, so that the toner particles are released both from the surface of the sleeve 22 and the surfaces of the brush 32.

In the back transfer phase, the electric field is directed as indicated by an arrow a. Since the toner particles 31''' on the photosensitive drum 1 are charged to the negative polarity, a part of the toner particles are transferred back to the sleeve 22 or to the magnetic carrier particles 30 by the electric field (a) formed in the space. In this manner, the toner particles reciprocate between the photosensitive drum 1 and the surface of the sleeve 22 and between the photosensitive drum 1 and the magnetic carrier particles. As the gap between the photosensitive drum 1 and the sleeve 22 is increased due to the rotations thereof, the electric field decreases, and the developing action is completed.

Since the magnetic carrier particles are charged to a positive polarity, which is opposite from the polarity of the toner, they receive a force in the direction b in the transfer phase, and receive a force in the direction a in the back transfer phase. In this manner, the vibratory action occurs. Because of the vibratory motion, the carrier particles promote in the toner particles thereon to release therefrom. On the other hand, a part of the carrier particles are torn from the chains to become easily deposited onto the drum 1. However, the present invention is effective to prevent the carrier particles from being deposited and remaining on the drum.

Description will be made with respect to the volumetric ratio f of the magnetic carrier particles in the developing zone. The "developing position" or "developing zone" is defined as the region in which the toner particles are transferred or supplied. The "volumetric ratio" is the percentage of the volume occupied by the magnetic carrier particles present in the developing zone to the entire volume of the developing position or zone.

The volumetric ratio of the magnetic carrier particles in the developing position is determined by;

$$(M/h)\times(1/\rho)\times[C/(T+C)]$$

where

- M is the weight of the developer (the mixture) per unit area of the sleeve surface when the erected chains are not formed ($g/cm^2$);
- h is the height of the space of the developing position (cm);
- $\rho$ is the true density of the magnetic carrier particles ($g/cm^3$);
- C/(T+C) is the percentage of the magnetic (carrier) particles in the developer on the sleeve.

The volumetric ratio is preferably 1.5–30%. If this is smaller than 1.5%, the image density of the developed image is too low; a ghost image appears in the developed image; a remarkable density difference occurs between the position where the chain 32 exists and the position where no chain exists; and or that the thickness of the developer layer formed on the sleeve 22 is not uniform.

If the volumetric ratio is larger than 30%, the surface of the sleeve is closed, that is, covered by the magnetic brush 32 too much, a foggy background results, and the development efficiency decreases.

Where the volumetric ratio is in the range of 1.5-30%, the chains 32 of the magnetic particles are formed on the sleeve surface and are distributed sparsely to a satisfactory extent, so that the toner particles on the chain surfaces and those on the sleeve surfaces are sufficiently opened toward the photosensitive drum 1, and the toner particles on the sleeve 22 are transferred by the alternating electric field. Accordingly, the development efficiency (the ratio of the toner consumable for the development to the overall toner present in the developing position), and also a high image density can be provided.

In order to obtain the volumetric ratio of the magnetic carrier particles in the developing zone, the gap between the drum 1 and the sleeve 22 in the developing zone, the gap between the developer layer thickness regulating blade 24 and the sleeve 22, the toner content in the developer and the like are properly selected in consideration of the relative relations among them.

Generally, it is preferable that the minimum clearance between the drum 1 and the sleeve 22 is 0.1-1 mm and that the clearance between the blade 24 and the sleeve 22 is 0.1-1 mm. The thickness of the developer layer is preferably such that if the magnetic pole S1 is present, the magnetic brush of the developer is contacted to the drum 1 in the developing zone, but if the magnet 23 is removed after the developer layer is formed on the sleeve 22 by the blade 24, the thickness of the developer is smaller than the minimum clearance between the sleeve 22 and the drum 1. The weight ratio of the toner to the magnetic carrier particles is preferably 4-40%.

Figure 1:
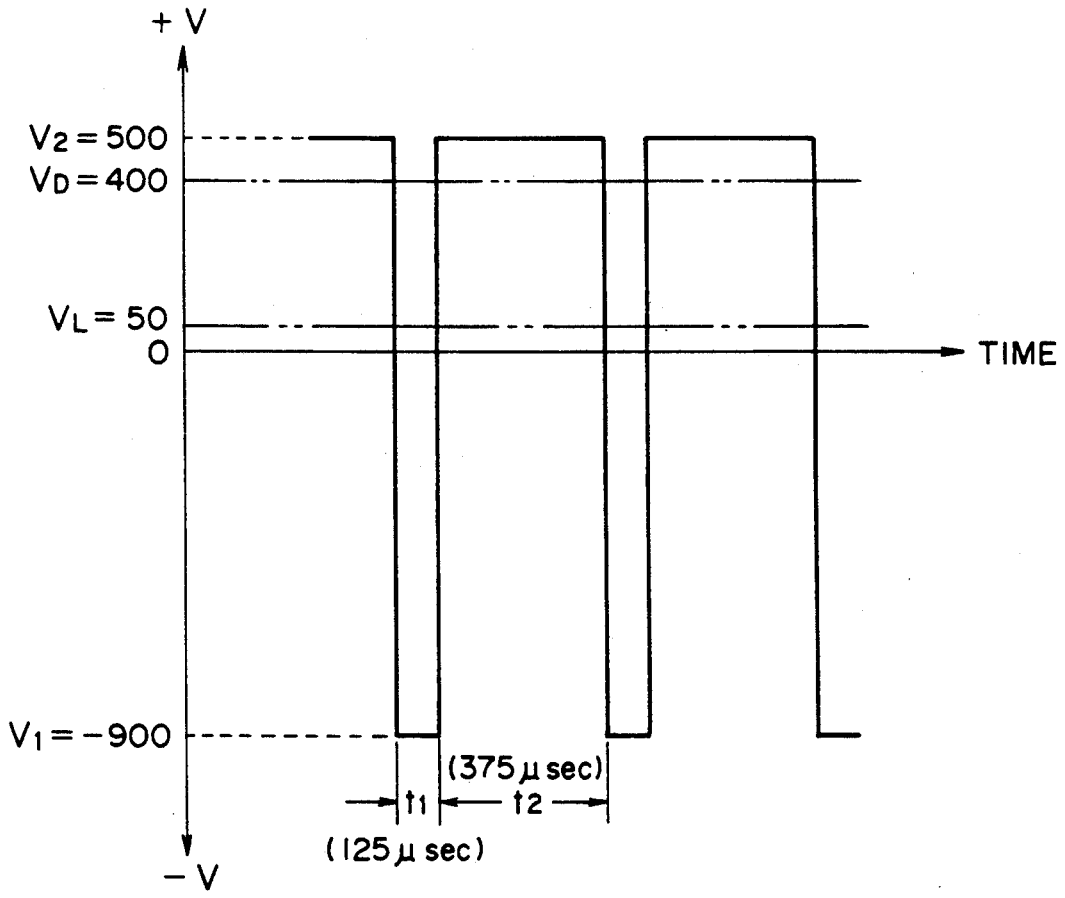
FIG. 1 shows a waveform of an oscillating bias voltage in an apparatus according to an embodiment of the present invention.

FIG. 1 shows a waveform of the oscillating bias voltage applied to the sleeve 22, where the dark potential $V_D$ (image portion potential) is +400 V; the light portion potential $V_L$ (non-image portion potential) is +50 V, and an electrostatic latent image having such potentials is developed by regular development; and the results are satisfactory.

The exemplified waveform has a duty ratio of 0.25, and the peak level in the transfer phase (that is, the peak level at the non-image portion side potential) V1 is −900 V, and the peak level in the back transfer phase (that is, the peak level at the image portion potential side) V2 is +500 V. Therefore, the peak-to-peak voltage Vpp is 1400 V. The voltage source 26 generates a DC voltage component ($V_{DC}$) of +150 V. The frequency is 2 KHz; the duration $t_1$ of the transfer phase is 125 micro-sec; and the duration of the back transfer phase $t_2$ is 375 micro-sec.

As will be understood from FIG. 1, for the image portion potential $V_D$, $Vu1max=|V_D-V1|=1300$ V $Vr1max=|V_D-V2|=100$ V; $Iu1=1300\times t_1=1.625\times 10^5$ V.micro-sec, and $Ir1=100\times t_2=0.375\times 10^5$ V.micro-sec.

For the non-image portion potential $V_L$, $Vu2max=|V_L-V1|=950$ V, $Vr2max=|V_L-V2|=450$ V; and $Iu2=950\times t_1=1.1875\times 10^5$ V.micro-sec, and $Ir2=450\times t_2=1.5875\times 10^5$ V.micro-sec.

Therefore, a maximum Vu1max of a potential difference Vu1 between an image portion potential of the electrostatic latent image and a potential of the developer carrying member in the transfer phase of the oscillating electric field, is larger than a maximum Vr1max of a potential difference Vr1 therebetween in the back transfer phase; a time integration Iu1 of the potential difference Vu1 is larger than a time integration Ir1 of the potential difference Vr1; a maximum Vu2max of a potential difference Vu2 between a non-image portion potential of the electrostatic latent image and a potential of the developer carrying member in the transfer phase of the oscillating electric field, is not less than a maximum Vr2max of a potential difference Vr2 therebetween in the back transfer phase; and a time integration Iu2 of the potential difference Vu1 is not more than a time integration Ir2 of the potential difference Vr2.

In this manner, a sufficient amount of the toner particles is deposited onto the image portion so as to provide sufficient image density; the halftone portion including the low potential portion is satisfactorily visualized; and thin lines are satisfactorily reproduced. The foggy background is not produced.

As contrasted to the prior art, the present invention is such that the maximum potential difference between the non-image portion potential of the latent image and the sleeve potential in the transfer phase is larger than the maximum potential difference therebetween in the back transfer phase. Thus, the toner is strongly urged in the direction from the sleeve to the drum. As a result, a sufficient amount of the toner is supplied to the image portion of the electrostatic latent image, and therefore, a sufficient amount of the toner particles is supplied to the edges of the line images, and in addition, a sufficient amount of the toner is supplied to the low potential portion.

However, if the toner is strongly urged toward the drum, the amount of toner deposited on the non-image portion is also increased. This may lead to the increase of the fog. Conventionally, fog is prevented by increasing the peak-to-peak voltage of the oscillating voltage. By doing so, the toner reversing force from the drum to the sleeve in the back transfer phase is also increased so as to remove the toner from the non-image portion of the drum by a strong force. However, if this is done, not only toner particles deposited on the non-image portion but also toner particles deposited on the image portion, the line image portion and the halftone image portion are excessively removed with the result of poor reproducibility of the line images and the low potential images, and the result of a low image density in the image portion.

In consideration of the above, according to the present invention, the duty ratio of the vibrating bias voltage is made smaller than 0.5, and the duration of the back transfer is made longer than the duration of the transfer. In other words, the time integration Ir2 of the potential difference in the back transfer phase is not less than the time integration Iu2 of the potential difference in the transfer phase, by which the foggy background toner deposited on the non-image portion is sufficiently removed, while on the other hand, a sufficient amount of the toner is caused to remain in the image portion (including line image portion) and the halftone image portion (including the low potential portion). The toner particles deposited on the non-image portion have weak electrostatic depositing force, and therefore, they can be sufficiently removed even by the relatively weak back transfer force if the duration of the back transfer force is relatively long. On the other hand, the toner particles deposited on the image portion or the halftone image portion have a electrostatic depositing force corresponding to the surface potential thereof, and therefore, they are not excessively removed by the relatively weak back transfer force even if the back transfer force acts for a relatively long period.

As regards the carrier particles, the back transfer electric field with which they are urged toward the drum is weak, and therefore, the carrier particles are prevented from remaining on the drum with the aid of the attraction force by the magnetic pole S1 for forming the magnetic field in the developing zone 12. In addition, the increased transfer electric field is effective to transfer the carrier particles once deposited on the drum, toward the sleeve by the transfer electric field and the magnetic attraction force provided by the magnetic pole S1.

Figure 4:
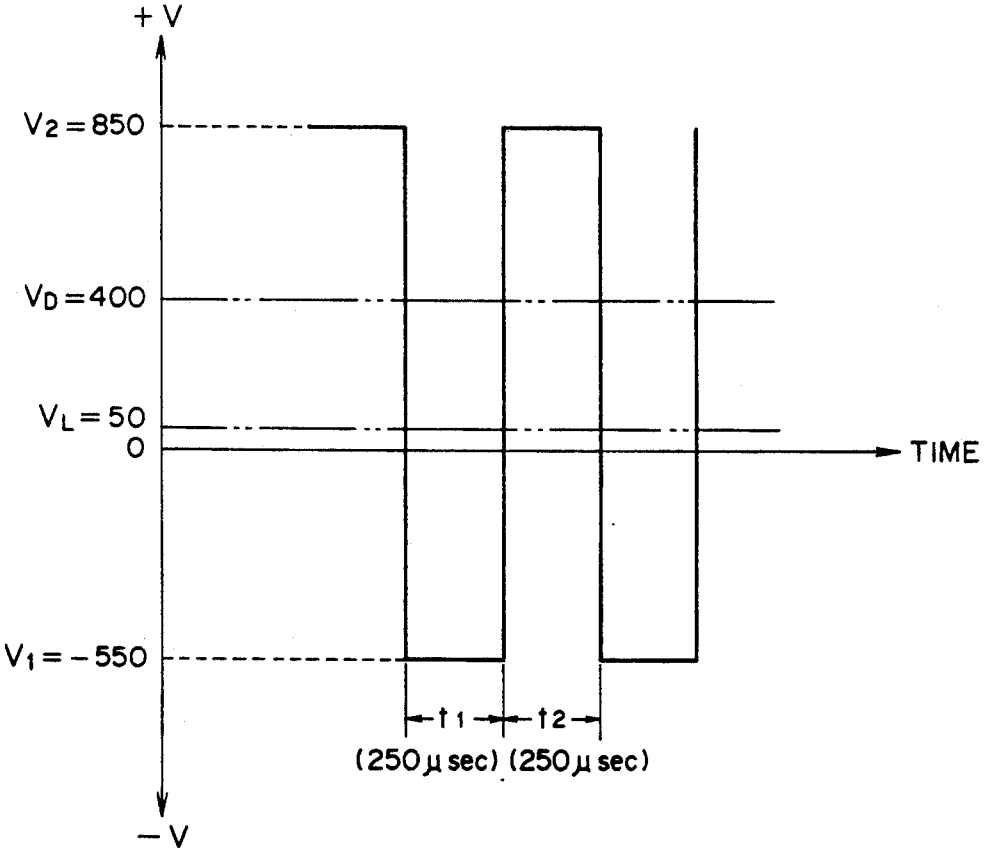
FIG. 4 PRIOR ART
FIG. 4 shows a waveform of an oscillating bias voltage in prior art apparatus.
Figure 5:
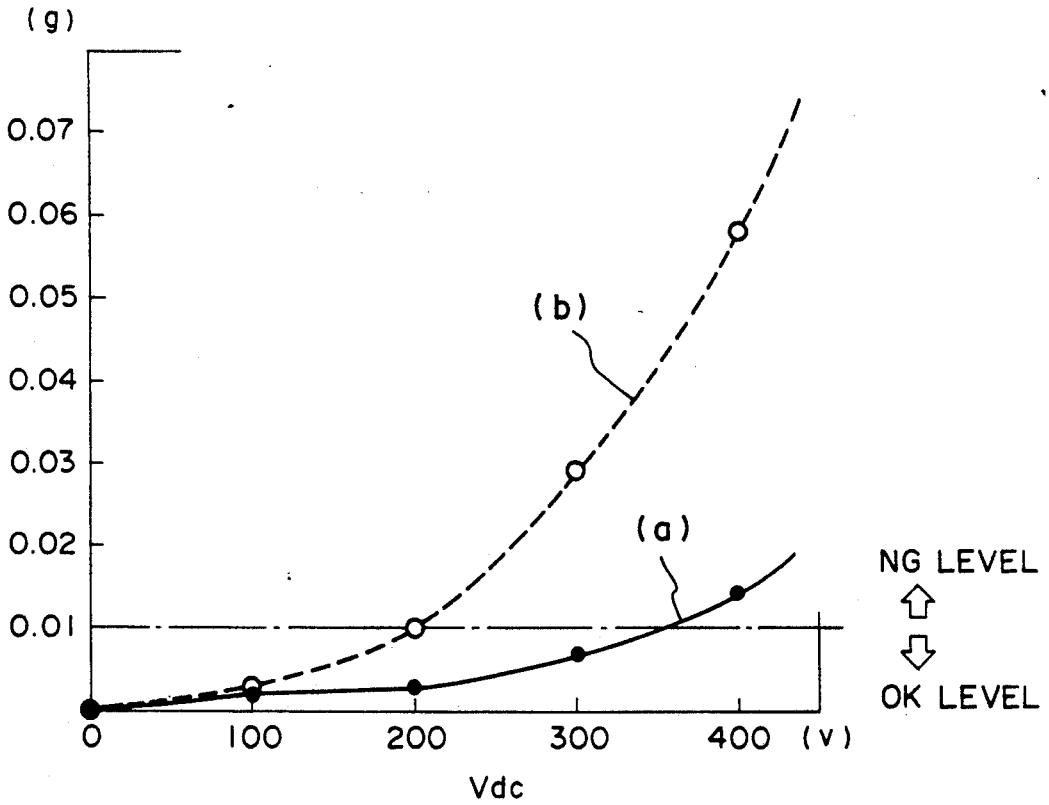
FIG. 5 illustrates amount of carrier particles deposition.

FIG. 5 shows the results of measurement of the carrier particles deposited on A3 sheet when solid white image is copied on a transfer sheet. The abscissa represents the DC voltage component provided by the DC source 26, and the ordinant represents the amount of carrier particles deposited. A curve (a) is plotted when the bias voltage has the waveform of FIG. 1; a curve (b) is plotted when the bias voltage has the waveform shown in FIG. 4 (the frequency is 2 KHz as in the case of FIG. 1, the duty ratio is 0.5, and the peak-to-peak voltage is 1400 V as in the case of FIG. 1). It will be understood that the amount of the carrier particles deposited is small in the curve (a).

In this embodiment, the photosensitive drum is of amorphous silicon photosensitive material. If it is replaced with an OPC (organic photoconductor) photosensitive material, the following problems arise.

Figure 6:
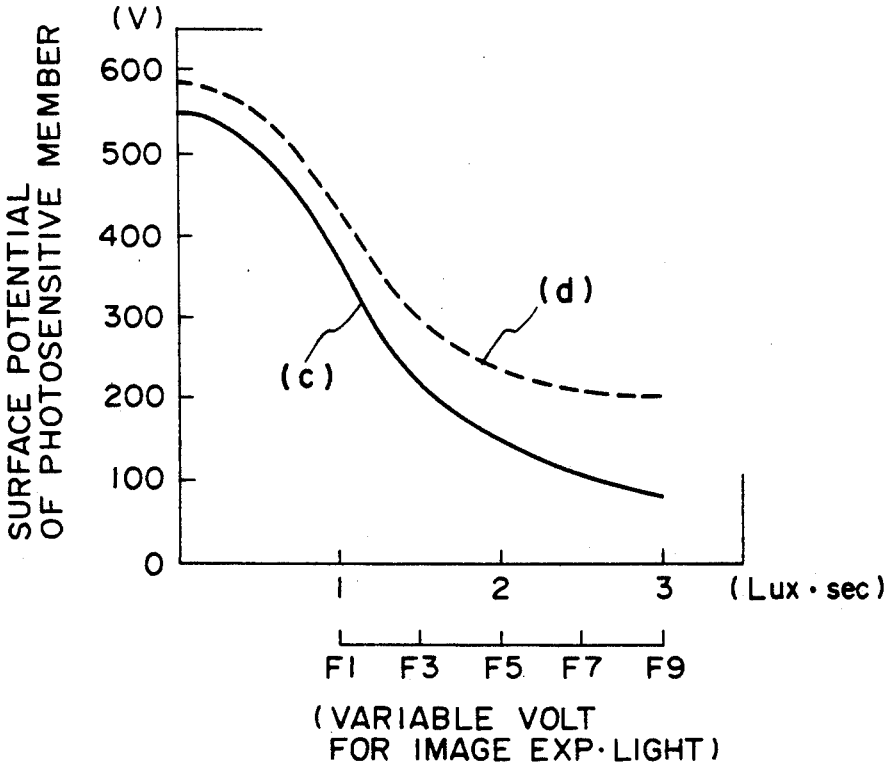
FIG. 6 illustrates characteristics of an OPC photosensitive member.

As shown in FIG. 6, in the case of the OPC photosensitive member, the E-V characteristics (the duration between the amount of the exposure and the surface potential) changes with use because of the influence by the remaining potential in the OPC photosensitive member. Curves (c) and (d) are E-V curves at the initial stage of use and after long term use, respectively. Therefore, if the proper image density is adjusted on the basis of the image exposure starting voltage, the image density does not change sufficiently even if the starting voltage is increased, after long term use.

Therefore, when the OPC photosensitive member is used, the image exposure voltage is made constant, and the DC component Vdc is made variable by a variable resistor 29 or the like, as shown in FIG. 2, so that the oscillating bias voltage waveform is translated (parallel shifting) to adjust the image density.

Figure 7:
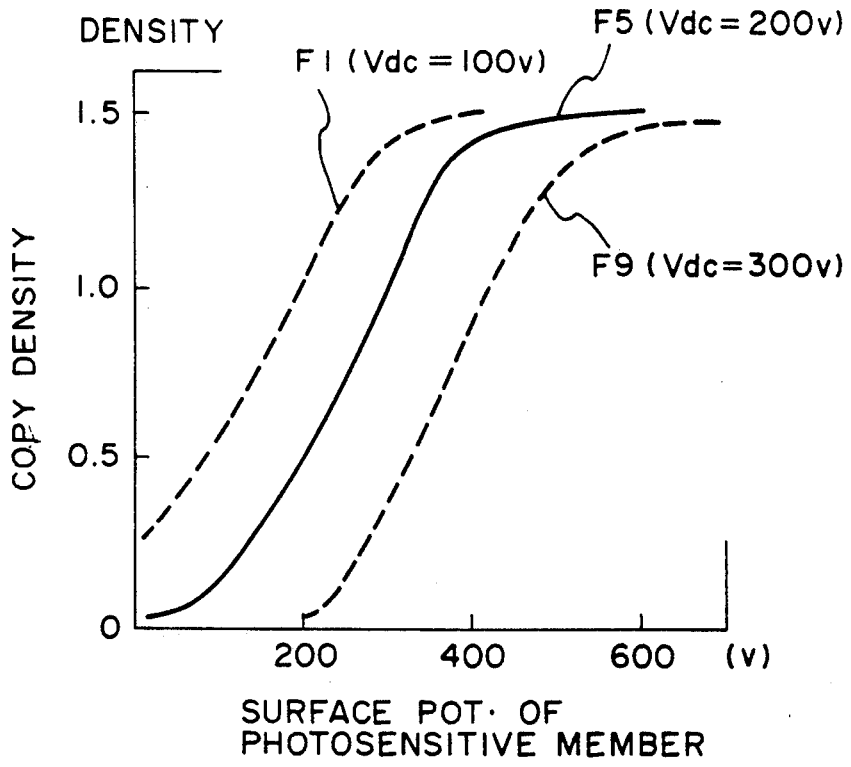
FIG. 7 illustrates image density control.

Since a two component developer is used, the V-D characteristics (the relation between the surface potential and the copy density) is fairly linear, and a linear adjustment is possible between the density adjustment levels F1–F9 (FIG. 7).

The use of the oscillating bias voltage having the duty ratio of less than 0.5, provides sufficient prevention of the carrier particles from remaining on the white portion, even if the level is F9 (Vdc is 300 V). In addition, after the long term use of an OPC photosensitive member, a proper image can be provided.

In the embodiment of the present invention, the oscillating bias voltage has the duty ratio of less than 0.5. However, the duty ratio is particularly preferably not less than 0.1 and not more than 0.4. If the duty ratio is larger than 0.4, the reproducibility for the line images is degraded, and the amount of carrier particles remaining on the drum becomes non-negligible. If the duty ratio is less than 0.1, the response property of the toner to the oscillating electric field is degraded with the result of poor reproducibility in the halftone region. Further preferably, the duty ratio is not less than 0.2 and not more than 0.3.

As regards the frequency of the oscillating bias voltage, it is preferably not less than 1.0 KHz and not more than 5 KHz. This is because if the frequency is lower than 1.0 KHz, removal of the foggy background becomes difficult even if tone reproduction is improved. The reason for this is considered as follows. When the frequency is low, the number of vibrations of the toner particles is small, and the toner urging force to the image bearing member by the transfer bias electric field is too strong in the non-image portion, and the toner particles deposited on the non-image portion are not sufficiently removed even by the toner removing force of the back transfer electric field and the coulomb force of the carrier particles.

If the frequency is larger than 5.0 KHz, the toner particles are unable to sufficiently respond to the oscillating electric field, and therefore, the developing property is remarkably degraded. Particularly, the best images are provided when the frequency of the oscillating bias electric field is not less than 1.5 KHz and not more than 3 KHz.

As to the peak-to-peak voltage Vpp of the oscillating bias voltage, satisfactory images are provided if it is not less than 1.5 KV, and in consideration of the current leakage to the latent image bearing member, the voltage Vpp is preferably not less than 1.0 KV and not more than 2.0 KV.

Figure 8:
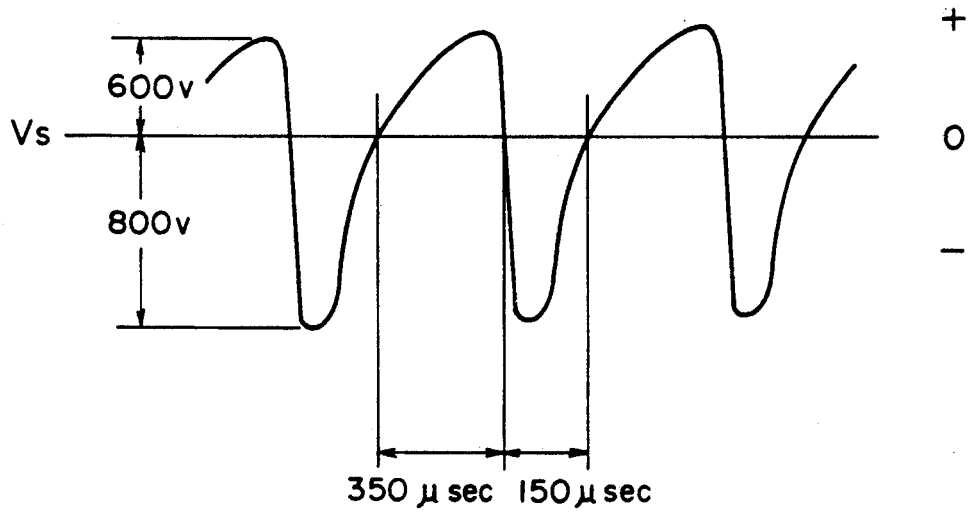
FIG. 8 shows a waveform of an oscillating bias voltage in an apparatus according to another embodiment of the present invention.

The same advantageous effects are obtained when the oscillating voltage has the sine-like waveform shown in FIG. 8. The present invention may use a triangular waveform or another waveforms.

The present invention is applicable to the two component developer in which the toner is positively charged, and it is also applicable to a reverse development system.

The present invention is applicable to an electrophotographic apparatus wherein an image of an original is directly projected on the photosensitive member, or the photosensitive member is scanned with a laser beam modulated in accordance with electric signals representative of the record. In addition, the present in invention is also applicable to the apparatus wherein an electrostatic latent image is formed by modulated flow of ions on a dielectric surface.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing an electrostatic latent image on an image bearing member, comprising:

a movable developer carrying member for carrying a layer of a developer containing toner particles and magnetic carrier particles to a developing zone, said toner particles and said magnetic particles being charged to opposite polarities;

a stationarily magnet disposed on a side of said developer carrying member opposite the image bearing member, said magnet forming a magnetic brush wherein the developer is contactable to the image bearing member in the developing zone;

a voltage source for producing an oscillating electric field in the developing zone by application of an oscillating bias voltage to said developer carrying member;

wherein said oscillating bias voltage satisfies a maximum Vu1max of a potential difference Vu1 between an image portion potential of the electrostatic latent image and a potential of the developer carrying member in a transfer phase of the oscillating electric field, is larger than a maximum Vr1max of a potential different Vr1 therebetween in a back transfer phase; a time integration Iu1 of the potential difference Vu1 is larger than a time integration Ir1 of the potential difference Vr1; a maximum Vu2max of a potential difference Vu2 between a non-image portion potential of the electrostatic latent image and a potential of the developer carrying member in the transfer phase of the oscillating electric field, is not less than a maximum Vr2max of a potential difference Vr2 therebetween in the back transfer phase; and a time integration Iu2 of the potential difference Vu1 is not more than a time integration Ir2 of the potential difference Vr2.

2. An apparatus according to claim 1, wherein said bias voltage has a duty ratio of not less than 0.1 and not more than 0.4.

3. An apparatus according to claim 2, wherein said bias voltage has a duty ratio of not less than 0.2 and not more than 0.3.

4. An apparatus according to claim 1, 2 or 3, wherein said bias voltage has a frequency of 1-5 KHz.

5. An apparatus according to claim 4, wherein said bias voltage has a frequency of 1.5-3 kHz.

6. An apparatus according to claim 5, wherein said bias voltage has a peak-to-peak voltage of 1-2 KV.

7. An apparatus according to claim 5, wherein a minimum gap between the image bearing member and said developer carrying member in the developing zone is 0.1-1.0 mm.

8. An apparatus according to claim 7, further comprising a regulating member faces to said developer carrying member to regulate a thickness of a layer of the developer to be conveyed to the developing zone, wherein a gap between said regulating member and said developer carrying member is 0.1-1.0 mm.

9. An apparatus according to claim 8, further comprising image control means effective to generate a waveform of the bias voltage.

10. An apparats according to claim 8, wherein the electrostatic latent image is developed with the toner particles on a surface of said developer carrying member and the toner particles on the magnetic brush in the developing zone in which the oscillating electric field is formed.

11. An apparatus according to claim 10, wherein a volumetric ratio of the carrier particles int h developing zone is 1.5-30%.

12. An apparatus according to claim 8, wherein the toner particles on a surface of said developer carrying member and the toner particles on the magnetic brush are both transferred onto the image bearing member to develop the electrostatic latent image, in the developing zone in which the oscillating electric field is formed.

* * * * *

UNITED STATES PATENT AND TRADEMARK OFFICE

CERTIFICATE OF CORRECTION

PATENT NO. : 5,187,523

DATED : February 16, 1993

INVENTOR(S) : OSAWA

It is certified that error appears in the above-identified patent and that said Letters Patent is hereby corrected as shown below:

Title page, item:

[57] ABSTRACT

Line 22, "differnece" should read --difference--.
Line 25, "carryign" should read --carrying--.

COLUMN 2

Line 56, "half tone" should read --halftone--.

COLUMN 4

Line 3, "with" should read --is--.
Line 47, "are" should be deleted.

COLUMN 5

Line 22, "is therefore," should read --is, therefore,--.
Line 29, "blade" should read --blade 24,--.

COLUMN 6

Line 34, delete "in".
Line 50, "by;" should read --by:--.

COLUMN 7

Line 1, "and or" should read --and/or--.
Line 59, "1300 V" should read --1300V,--.
Line 60, "100" should read --100 V;--.

UNITED STATES PATENT AND TRADEMARK OFFICE

CERTIFICATE OF CORRECTION

PATENT NO. : 5,187,523

DATED : February 16, 1993

INVENTOR(S) : OSAWA

It is certified that error appears in the above-identified patent and that said Letters Patent is hereby corrected as shown below:

COLUMN 9

Line 2, "a" should read --an--.
Line 22, "ordinant" should read --ordinate--.

COLUMN 10

Line 37, "waveforms." should read --waveform--.
Line 47, "in" should be deleted.
Line 66, "stationarily" should read --stationary--.

COLUMN 12

Line 10, "faces" should read --faced--.
Line 18, "apparats" should read --apparatus--.
Line 25, "int h" should read --in the--.

Signed and Sealed this

First Day of February, 1994

Bruce Lehman

*Attest:*

BRUCE LEHMAN

*Attesting Officer*

*Commissioner of Patents and Trademarks*